United States Patent [19]

Malashenko

[11] Patent Number: 4,759,280

[45] Date of Patent: Jul. 26, 1988

[54] HYDRAULIC PRESS WITH ADJUSTABLE PLATEN CLEARANCE

[75] Inventor: Leon Malashenko, Toronto, Canada

[73] Assignee: John T. Hepburn, Limited, Mississauga, Canada

[21] Appl. No.: 947,263

[22] Filed: Dec. 29, 1986

[51] Int. Cl.[4] ..... B30B 15/06

[52] U.S. Cl. ..... 100/257; 100/214; 425/193; 425/450.1; 425/451.2

[58] Field of Search ..... 72/453.02, 453.06, 453.08; 100/295, 219, 257, 214; 425/150, 406, 450.1, 451.2, 451.9, 589, 590, 595, 182, 193

[56] References Cited

U.S. PATENT DOCUMENTS

| | | | |
|---|---|---|---|
| 2,718,663 | 9/1955 | Roger | 425/451.2 |
| 3,270,372 | 9/1966 | Hesse | 425/451.2 |
| 3,669,593 | 6/1972 | Cyriax | 425/451.2 |
| 3,687,590 | 8/1972 | Cyriax | 425/450.1 |
| 3,716,323 | 2/1973 | Classen | 425/451.2 |
| 4,130,384 | 12/1978 | MacMillan | 425/451.2 |
| 4,240,781 | 12/1980 | Flickinger et al. | 425/451.2 |
| 4,304,540 | 12/1981 | Hammon | 425/150 |
| 4,448,575 | 5/1984 | Hanyu et al. | 425/451.2 |
| 4,648,823 | 3/1987 | Yashima | 425/406 |

FOREIGN PATENT DOCUMENTS

| | | | |
|---|---|---|---|
| 46-96643 | 3/1971 | Japan | 425/451.2 |
| 2128541 | 5/1984 | United Kingdom | 425/451.2 |

*Primary Examiner*—Jeffery Thurlow
*Assistant Examiner*—Jill L. Fortenberry

[57] ABSTRACT

A hydraulic press has a frame including a crosshead formed with a vertical passage. A lower platen is fixed to the base of the frame, and an upper movable platen is located between the crosshead and lower platen. Light-duty hydraulic cylinders move the upper platen between an operating position proximate to the lower platen and a retracted position relatively distant from the lower platen. A short-stroke, large-bore hydraulic ram extends vertically from the upper platen and travels with the upper platen is positioned by the light-duty cylinders. An upper free end of the ram locates in the vertical passage of the crosshead when the upper platen is in its retracted position but clears the passage when the upper platen is in its operating position. A hydraulic mechanism then closes the passage so that the ram can drive the upper platen towards the lower platen. The length of the ram can be varied with mechanical spacers which seat in a recess formed in the upper end of the ram to adjust platen clearance in the operating position in order to accommodate molds or other workpieces of different heights.

9 Claims, 2 Drawing Sheets

HYDRAULIC PRESS WITH ADJUSTABLE PLATEN CLEARANCE

FIELD OF THE INVENTION

The invention relates generally to hydraulic presses, and more particularly, to improvement of press reaction and cycle times.

DESCRIPTION OF THE PRIOR ART

The invention will be described below in the context of a hydraulic press intended primarily for compression molding processes including in-mold coating, but it should be understood that the invention is not strictly limited to such presses.

Conventional compression molding presses often have upper and lower platens between which a mold can be compressed. A typical arrangement involves a movable upper platen which is guided on frame side slabs to and from the lower platen and which is moved through its full range of operation by a large central ram suspended from the crosshead.

The molds used in connection with such presses may typically be constructed in halves, one half normally being bolted to the upper platen, the other half to the lower platen. In such an arrangement, the central ram must have a comparatively long stroke in order to accommodate molds of various height and to permit sufficient separation of the mold halves that a particularly deep product can be removed. More specifically, the ram must have a stroke sufficient to move the upper platen from a retracted position in which there is sufficient clearance between the platens to permit removal of molded products and introduction of fresh molding charges to an operating position in which compression phases of operation can be commenced and ultimately to lower positions associated with actual compression phases. In typical applications, the stroke of the central ram may well be in excess of 48 inches in order to accommodate the full range of platen movement. In contemporary compression molding processes involving plastic products the ram may also be required to exert compressive forces in excess of 2,000 tons, although through only a small range of platen movement. Accordingly, the central ram would typically have a very substantial diameter and long stroke which results in a large capacitance and comparatively slow reaction time.

The cycle time required for production of a mold product in such presses is comparatively long because the ram tends to react slowly to the introduction of hydraulic fluid. Pre-fill valves are commonly used to provide faster delivery of hydraulic fluid to the ram, but the volumes of fluid must nevertheless be compressed to a working pressure and thereafter decompressed, factors which contribute to lengthy cycle time. Additionally, a pre-fill valve limits the speed at which a platen can be advanced as cavitation tends to occur if flow rates through the pre-fill valve exceed the rated flow capacity of the valve. Also, pre-fill valves contribute considerably to the cost of a press.

Despite the shortcomings inherent in such presses, they have a reliable design which may still be preferred by end users. It would accordingly be desirable to provide a press incorporating essentially the basic features of such prior presses, but characterized by faster reaction times. It would also be desirable to improve the operation of such presses in a comparatively inexpensive manner.

BRIEF SUMMARY OF THE INVENTION

In one aspect, the invention provides a press having a frame formed with a passage. A reaction member which may be a conventional platen is attached to the frame, and a movable platen located between the passage and the reaction member. Platen positioning means serve to support the platen and to move the platen between an operating position, one appropriate for the commencement of compression phases of operation, and a retracted position, one in which the movable platen and reaction member are separated sufficiently that molds or other workpieces can be installed or products removed. The platen positioning means preferably take the form of a number of fast-acting, light-duty hydraulic cylinders dedicated to moving the platen between its operating and retracted positions and more generally to supporting the moving platen when required at the various positions it may assume.

A hydraulic ram drives the platen towards the reaction member for purposes of compressing materials therebetween. The hydraulic ram has a fixed ram end portion which is attached to the platen for movement therewith and a free ram end portion which locates within the passage provided in the frame when the platen is in its retracted position and which is clear of the passage when the platen is in its operating position. Closure means serve to close the frame passage against entry of the free ram end portion when the platen is in the operating position. When the hydraulic ram is then actuated, the free ram end engages the closure means permitting the hydraulic ram to drive the platen towards the reaction member.

In such an arrangement, the hydraulic ram need not extend or contract to travel with the platen during either initial positioning of the platen in preparation for compression phases of operation or subsequent retraction of the platen for removal of product. Since in compression molding processes the ram might actually be required to produce compressive forces throughout only an inch or more of platen travel, the ram can incorporate a hydraulic mechanism with a comparatively short stroke. Accordingly, the capacitance of the ram can be very markedly reduced, permitting comparatively fast reaction time and in many applications reduced cycle time. This arrangement can also eliminate the need for expensive pre-fill valves as smaller volumes of hydraulic fluid can be to operate the ram.

Other inventive aspects of the press and associated advantages will be discussed more fully below in connection with a preferred embodiment and will be more specifically defined in the appended claims.

DESCRIPTION OF THE DRAWINGS

The invention will be better understood with reference to drawings illustrating a preferred embodiment of a press, in which.

Figure 1:
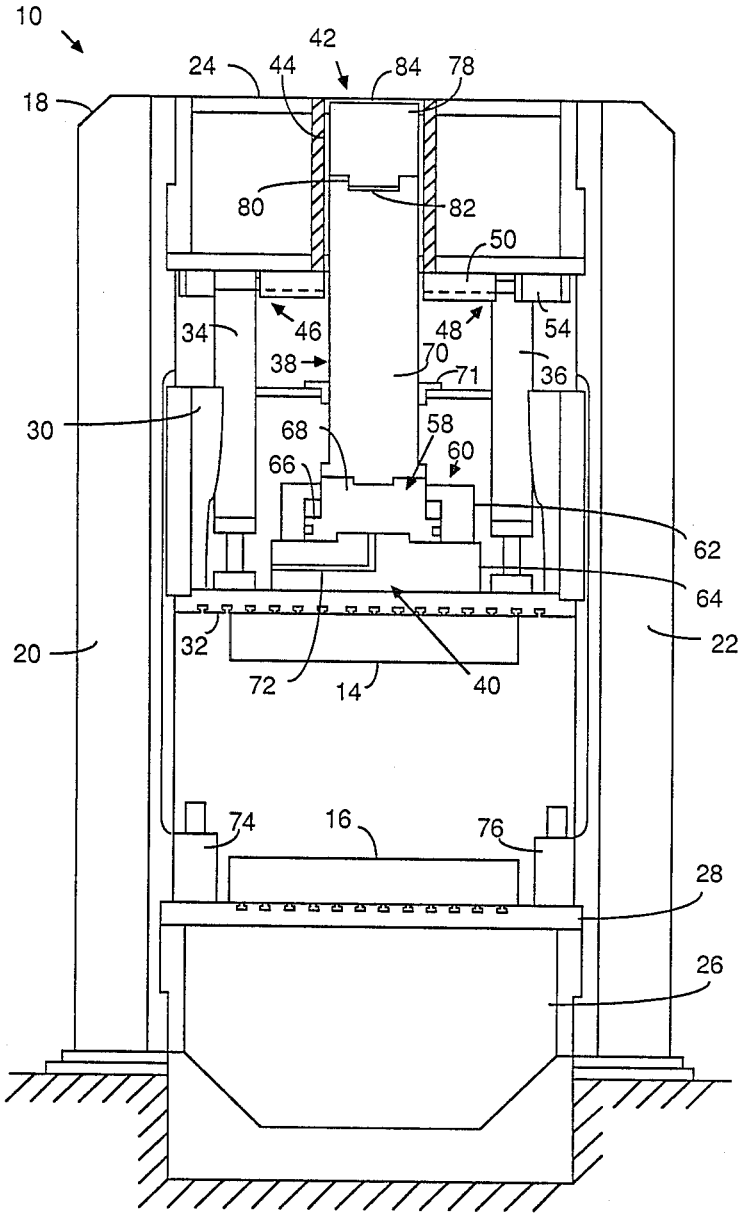
FIG. 1 is a elevational view of the press with an upper movable platen located in a retracted position, the view being fragmented to show the position of a free end of a central ram relative to a vertical passage formed centrally in a press crosshead and to show the certain structure located in the interior of the upper platen; and, FIG. 2 is a view of the press similar to that of FIG. 1 but with the upper platen in an operating position appropriate for commencement of compression phases of operation.

In the drawings certain clearances have been exaggerated for the purposes of better illustrating the invention.

DESCRIPTION OF PREFERRED EMBODIMENT

Figure 2:
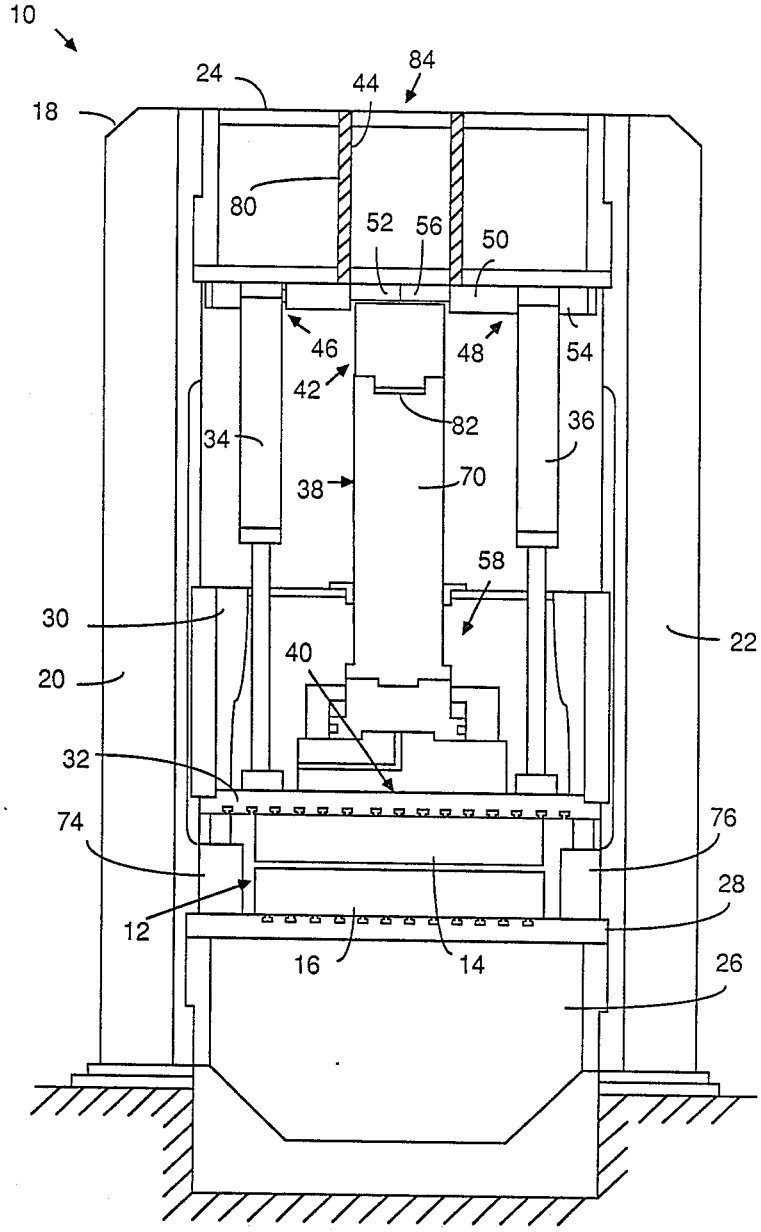

Reference is made to FIGS. 1–2 which illustrate a hydraulic press 10 which may have a 2000 ton capacity. The press 10 will be described in the context of compression molding processes involving a conventional mold 12 constructed in upper and lower mold halves 14, 16 between which a molding charge is compressed.

The press 10 has a robust frame 18 of steel plate construction. The frame 18 includes a pair of opposing side slabs 20, 22 and an upper crosshead 24 supported by the slabs 20, 22. The base structure of the frame 18 defines a fixed lower platen 26, the upper surface of which is defined by a conventional T-slotted bolster plate 28 that permits the lower mold half 16 to be attached with bolts. The lower platen 26 is reinforced in a customary manner to withstand the loads expected during compression phases of operation. The press 10 has a movable upper platen 30 which includes a conventional T-slotted bolster plate 32 to which the upper mold half 14 is bolted in a conventional manner. The upper platen 30 is also reinforced in the customary manner to provide the rigidity required to withstand any significant deflection during compression phases of operation.

A pair of light-duty hydraulic cylinders 34, 36 extend through clearance holes formed at the top of the upper platen 30 and are connected between the crosshead 24 and the bolster plate 32 of the upper platen 30. These cylinders 34, 36 serve to move the upper platen 30 between an operating position (as in FIG. 2) relatively proximate to the lower platen 26 and a retracted position (as in FIG. 1) relatively distant from the lower platen 26. These cylinders 34, 36 can be controlled if required to support the platen 26 at any position in its full range of movement.

A vertical central ram 38 serves as the means for driving the upper platen 30 against the lower platen 26 to compress the mold halves 14, 16. The ram 38 has a lower fixed end portion 40 which is fixed to the bolster plate 32 for movement with the upper platen 30 and an upper free end portion 42. The free ram end portion 42 locates within a vertical passage 44 formed in the crosshead 24 when the upper platen 30 is in its retracted position and clears the passage 44 when the upper platen 30 is in its operating position.

Once the upper free end portion 42 of the hydraulic ram 38 is clear of the passage 44, a hydraulic closure mechanism can be actuated to move its components from an open position (as illustrated in FIG. 1) to a closed position (as illustrated in FIG. 2) in which the closure mechanism obstruct travel of the free ram end portion 42 through the passage 44. The closure mechanism has two identical subassemblies 46, 48. The subassembly 48 includes a guide structure 50 bolted to the bottom of the crosshead 24 which defines an internal rectangular passage in which a gate member 52 (essentially a solid rectangular steel plate) is retained and able to slide horizontal towards and away from the passage 44. A hydraulic cylinder 54 mounted on the bottom of the crosshead 24 can be selectively actuated to advance the gate member 52 from a retracted position as in FIG. 1 in which the gate member 52 is contained within the guide structure 50 and an advanced position in which the gate member 52 covers half the lower passage 44 opening. The other subassembly 46 is similarly constructed and operates a gate member 56 in a similar manner.

Actuation of the ram 38 causes a separation of the fixed and free ram end portions 40, 42. With the closure mechanism obstructing the passage 44, the free ram end portion 42 extends upwardly to engage the gate members 52, 56. The gate members 52, 56 are positioned sufficiently close to free ram end portion 42 when the upper platen 30 is placed in its operating position that the free ram end portion 42 engages the gate members 52, 56 before a hydraulic cylinder 58 associated with the ram 38 has exhausted an appreciable amount of its stroke or potential range of movement. Accordingly, once the free ram end portion 42 engages the gate members 52, 56, the ram 38 exerts a downward driving force on the upper platen 30 which the compress the mold 12 between the lower and upper platens 26, 30.

The construction of the hydraulic ram 38 should be noted. In particular, when not actuated, the ram 38 resets under gravity to an orientation in which it is fully contracted and ready to commence compressions phases of operation. The hydraulic cylinder 58 associated with the ram 38 has a sealed housing 60 constructed as two upper and lower parts 62, 64 which are bolted together. The lower housing part 64 defines a seating surface for a piston 66 contained within the housing 60 and vertically movable within the housing 60. The piston 66 is integrally formed with a piston rod 68 which extends vertically through the interior of the housing 60 to points external, and piston rod extension member 70 is bolted to the upper end of the piston rod 68 and extends upwardly through the interior of the platen 30. Movement of the extension member 70 is guided by a bushing 71 seated in an upper surface of the upper platen 30. A fluid port 72 formed in the lower housing part 64 permits the application of hydraulic fluid under pressure to the interior of the housing 60 immediately below the piston 66 in order to drive the piston 66 and piston rod 68 upwardly thereby effectively extending the hydraulic ram 38 and separating the fixed and free ram end portions 40, 42. Since the piston 66, piston rod 68 and extension member are not attached to the frame 18 but associated with the free ram end portion 42, they are free to descend under gravity when hydraulic fluid is allowed to drain from the interior of the housing 60 through the fluid port 72 thereby contracting the ram 38. If desired the descent can be controlled with appropriate valves to limit the amount of contraction which occurs. This resetting will occur whenever fluid press is removed from the ram 38, as when the light-duty cylinders are used for gross positioning of the mold halves or when certain leveling cylinders described more fully would be actuated to strip the mold 12. Accordingly, hydraulic pumps are not required to reset the ram 38 to recommence compression of the mold 12, thereby reducing the cost of constructing the press 10 and also reducing cycle time by several seconds.

The total range of movement of the upper platen 30 in such a press might typically be about four feet (but may be as much as seven feet depending on the overall height of the press and the range of mold heights the press has been designed to accommodate). The bulk of this range of movement is under the influence of the light-duty cylinders 34, 36 thereby allowing the central ram 38 to be constructed with a stroke of no more than the three inches, more than enough in contemporary compression molding processes to close a mold and complete compression of a contained charge. Accordingly, the central ram 38 can be constructed with markedly lower capacitance than has been characteristic of the prior presses described above and with a consequent ability to respond quickly to the application of hydraulic fluid under pressure. The need for pre-fill valves is accordingly eliminated.

According to current process for compression molding thin plastic products, a strict measure of parallelism would be required between the lower and platens 26, 30 during compression phases of operation. To permit in-mold coating or surface treatment of such products, the press 10 must also be capable of separating the upper and lower mold halves 14, 16 under considerable forces created in the interior of the mold 12 for a brief period during the compression process to permit injection of a surface coating. The press 10 is advantageously adapted for such parallelism control and mold separation by providing four hydraulic leveling cylinders (only two such cylinders 74, 76 being apparent in FIGS. 1 and 2) attached to the four corners of the lower bolster plate 28 associated with the lower platen 26. These leveling cylinders engage the upper platen 30 when the separation between the platens 26, 30 is less than a predetermined distance (as in FIG. 2), and are hydraulically controlled in response to platen separation sensors (not illustrated) that detect the separation of the lower and upper platens 26, 30 at the four corners of the platens 26, 30. Such an arrangement of leveling cylinders has been proposed previously as means for retrofitting existing presses of the down-acting central ram type for parallelism control. The implementation of the necessary controls to regulate platen parallelism in connection with such leveling cylinders will be readily apparent to those skilled in the art.

The combination of the leveling cylinders with the free-standing central ram 38 is regarded as singularly advantageous arrangement for implementing parallelism control in connection with compression molding processes involving in-mold coating. Because the upper free end portion of the ram 38 is not connected to the frame structure, it is not possible to separate the mold halves 14, 16 by appropriately adapting the central ram 38 for double-acting operation (as by providing an upper fluid port in the cylinder housing 60). The four leveling cylinders which would normally be sized to resist very substantial compressive forces serve in this arrangement as the means for achieving the minimal mold separation required for in-mold coating processes (by overcoming the downward action of the central ram 38) and final stripping.

The central ram 38 can be adapted to accommodate mold of varying height. As apparent in FIGS. 1 and 2, a passive extension member 78 simply seats in a recess 80 formed in the upper end of the piston rod extension member 70. By substitution of a similar extension member of greater height the overall length of the ram 38 can be increased to permit a mold of relatively small height to be compressed. Alternatively, if desired or necessary, passive spacer shims such as the shim 82 illustrated can be placed at the bottom of the recess to provide incremental increases in the overall length of the hydraulic ram 38. The vertical frame passage 44 has been formed with an open upper end 84 at the top of the crosshead 24 to permit such extension members or shims to be conveniently inserted or removed from the recess 80 through the passage 44, as with a small hoist. Since molds are normally changed infrequently, this arrangement is convenient and much less expensive than current proposals in the art regarding providing means for continuously or incrementally varying the position of a movable platen relative to side slabs or guide posts and then locking the platen to the guide structure with elaborate friction or mechanical locking mechanisms.

The operation of the press in compression molding processes with or without parallelism control and in-mold coating will be readily apparent to those skilled in the art.

It will be appreciated that a particular embodiment of the invention has been described, and that modifications may be made therein without departing from the spirit of the invention or the scope of the appended claims. In particular, although a single central ram has been illustrated, it will be apparent that the press can be adapted to accommodate a plurality of such free-standing rams by providing additional vertical passages in the crosshead and additional closure mechanisms. Also, the closure means need not necessarily take the form of gate members or the like mounted on the press frame for movement between open and closed orientations in which they permit or obstruct access to the passage. For example, closure of the passage against entry of the ram free end portion may be effected in part by forming the passage with a rectangular cross-section transverse to its vertical longitundinal axis and forming the passive extension member seated in the recess at the top of the free ram end portion with a similar cross-section of slightly smaller dimensions. Accordingly, a rotation means mounted within the piston rod extension member or on the bottom surface of the crosshead can serve to rotate the passive extension member through an appropriate angle relative to a vertical axis into an orientation which precludes re-entry of the ram free end portion into the passage and which causes an abuttment of the free ram end portion, specifically the passive extension member, against lower surface of the crosshead for purposes of driving the upper platen against the lower platen. These features, namely, appropriate shaping of at least part of the upper ram end portion and the passage together with means for selectively rotating the upper ram end portion relative to the passage, constitute a closure means appropriate for purposes of the invention. Such modifications are not preferred for reasons of cost and difficulty of implementation; however, they should be regarded as falling within the ambit of the appended claims.

I claim:

1. A press comprising:

a frame having a passage;

a reaction member attached to the frame;

a movable platen located between the passage and the reaction member;

platen positioning means for supporting the platen and for moving the platen between an operating position relatively proximate to the reaction member and a retracted position relatively distant from the reaction member;

a hydraulic ram having a fixed ram end portion which is attached to the platen for movement therewith and having a free ram end portion which locates within the passage when the platen is in the retracted position and which is clear of the passage when the platen is in the operating position, the hydraulic ram vertically separating the fixed ram end portion and the free ram end portion when hydraulically actuated;

passive extension means realeasably attachable to the free ram end portion for extending the free ram end portion; and, closure means for closing the passage against entry of the free ram end portion when the platen is in the operating position so that actuation of the hydraulic ram causes the hydraulic ram to drive the platen towards the reaction member.

2. A press as claimed in claim 1 in which the hydraulic ram is vertically oriented with the free ram end portion above the fixed ram end portion and in which the ram includes a hydraulic cylinder for separating the fixed ram end portion relative to the free ram end portion, the hydraulic cylinder comprising:

a sealed housing;

a piston located in the interior of the housing and movable vertically within the housing;

a piston rod attached to the piston and extending upwardly through the interior of the housing to the exterior of the housing; and, a fluid port associated with the housing for introducing hydraulic fluid under pressure into the interior of the housing below the piston;

whereby the ram contracts under gravity when pressure is removed from the fluid port.

3. A press as claimed in claim 2 in which the platen positioning means comprise a plurality of hydraulic cylinders connected between the frame and the platen.

4. A press as claimed in claim 1 in which the closure means comprise:

a closure member; and, hydraulic cylinder means attached to the frame for moving the closure member between a open position in which the closure member is clear of the passage and a closed position in which the closure member obstructs the passage.

5. A press comprising:

a frame having a crosshead formed with a vertical passage;

a lower platen attached to the frame;

a movable upper platen located between the crosshead and the lower platen;

a plurality of hydraulic cylinders connected between the frame and the upper platen for moving the upper platen between an operating position relatively proximate to the lower platen and a retracted position relatively distant from the lower platen;

a hydraulic ram having a fixed ram end portion which is attached to the upper platen for movement therewith and having a free ram end portion which locates within the passage when the upper platen is in the retracted position and which is clear of the passage when the upper platen is in the operating position, the hydraulic ram vertically separating the fixed ram end portion and the free ram end portion when hydraulically actuated;

passive extension means releasably attachable to the free ram end portion for extending the free ram end portion; and, closure means for closing the passage against entry of the free ram end portion when the upper platen is in the operating position so that actuation of the hydraulic ram causes the hydraulic ram to drive the upper platen towards the lower platen.

6. A press as claimed in claim 5 in which the hydraulic ram is vertically oriented with the free ram end portion above the fixed ram end portion and in which the ram includes a hydraulic cylinder for separating the fixed ram end portion relative to the free ram, the hydraulic cylinder comprising:

a sealed housing;

a piston located in the interior of the housing and movable vertically within the housing;

a piston rod attached to the piston and extending upwardly through the interior of the housing to the exterior of the housing; and, a fluid port associated with the housing for introducing hydraulic fluid under pressure into the interior of the housing below the piston;

whereby the ram contracts under gravity when pressure is removed from the fluid port.

7. A press as claimed in claim 5 comprising a multiplicity of leveling cylinders attached to the lower platen for engaging the upper platen when the separation between the upper and lower platens is less than a predetermined distance to maintain a predetermined relationship between the upper and lower platens.

8. A press as claimed in claim 5 in which the free ram end portion is formed with a recess and the passive spacing means comprise a spacer adapted to seat in the recess.

9. A press as claimed in claim 8 in which the passage has an open end at an upper surface of the crosshead so that the spacer can be removed from or seated in the recess through the passage.

* * * * *